US007891659B2

(12) United States Patent
Inoue et al.

(10) Patent No.: US 7,891,659 B2
(45) Date of Patent: Feb. 22, 2011

(54) PAPER FEEDING DEVICE, RECORDING APPARATUS AND INFORMATION PROCESSING APPARATUS HAVING THE SAME

(75) Inventors: Nobuhiro Inoue, Matsumoto (JP); Hiroyuki Takahashi, Masukuwa-mura (JP)

(73) Assignee: Seiko Epson Corporation, Tokyo (JP)

( * ) Notice: Subject to any disclaimer, the term of this patent is extended or adjusted under 35 U.S.C. 154(b) by 360 days.

(21) Appl. No.: 12/002,544

(22) Filed: Dec. 18, 2007

(65) Prior Publication Data

US 2008/0272536 A1 Nov. 6, 2008

(30) Foreign Application Priority Data

Dec. 21, 2006 (JP) ..... 2006-345057

(51) Int. Cl.
*B65H 1/00* (2006.01)

(52) U.S. Cl. ..... 271/145; 271/162

(58) Field of Classification Search ..... 271/167, 271/169, 170, 241, 248, 250, 37, 113, 145, 271/162

See application file for complete search history.

(56) References Cited

U.S. PATENT DOCUMENTS

| | | | | |
|---|---|---|---|---|
| 4,374,586 | A * | 2/1983 | Lamos et al. | 271/37 |
| 4,397,456 | A * | 8/1983 | Eberle | 271/10.01 |
| 5,286,018 | A * | 2/1994 | Rasmussen et al. | 271/147 |
| 5,411,248 | A * | 5/1995 | Yamaguchi | 271/171 |
| 5,651,540 | A | 7/1997 | Watanabe et al. | |
| 7,571,908 | B2 * | 8/2009 | Inui et al. | 271/251 |
| 2002/0060400 | A1 * | 5/2002 | Kobayashi et al. | 271/145 |
| 2003/0116909 | A1 * | 6/2003 | Polidoro et al. | 271/250 |
| 2005/0023744 | A1 * | 2/2005 | Okamoto | 271/113 |
| 2006/0244194 | A1 * | 11/2006 | Terashima et al. | 271/10.11 |

FOREIGN PATENT DOCUMENTS

| | | |
|---|---|---|
| JP | 62-046842 | 2/1987 |
| JP | 64-43045 | 3/1989 |
| JP | 2966243 | 8/1999 |
| JP | 2000-233850 | 8/2000 |
| JP | 2005-194080 | 7/2005 |

* cited by examiner

*Primary Examiner*—Stefanos Karmis
*Assistant Examiner*—Patrick Cicchino
(74) *Attorney, Agent, or Firm*—Nutter McClennen & Fish LLP; John J. Penny, Jr.

(57) ABSTRACT

A paper feeding device includes: a reference guide surface that contacts a lateral end portion of a sheet-shaped medium along a guide path for transporting the medium; a tapered guide surface that is inclined outward from the reference guide surface toward an upstream side of a transport direction and contacts the lateral end portion of the medium; a paper feeding roller that rotates to transport the medium in a direction parallel to the reference guide surface while the paper feeding roller contacts a surface of the medium; and a medium cassette that stores the medium. The medium cassette stores the medium so as to be inclined with respect to the reference guide surface so that a rear end of the lateral end portion of the stored medium at a side of the reference guide surface is positioned outside an imaginary extension surface of the reference guide surface.

13 Claims, 7 Drawing Sheets

PAPER FEEDING DEVICE, RECORDING APPARATUS AND INFORMATION PROCESSING APPARATUS HAVING THE SAME

This application claims priority under 35 U.S.C. §119 from Japanese Patent Application No. 2006-345057 filed on Dec. 21, 2006, the entire disclosure of which is expressly incorporated by reference herein.

BACKGROUND

1. Technical Field

The present invention relates to a paper feeding device that feeds a sheet-shaped medium such as a paper, and to a recording apparatus and an information processing apparatus having the same.

2. Related Art

Recording apparatuses and information processing apparatuses such as printers, copiers, or facsimiles, which record characters or images on a paper that as a sheet-shaped medium, are provided with a paper feeding device that feeds a paper stored in a paper cassette to a recording processing portion such as a print head.

As a printer provided with such a paper feeding device, there is one having a paper cassette that has a protrusion formed on an inner surface and having a device that corrects a posture of a paper by bringing a rear lateral end portion of the paper into contact with the protrusion (see Patent Document 1 for example).

In a printer having a device for reversing and feeding a paper to a recording apparatus, there is known a device in which a paper is transported by an oblique roller that is inclined with respect to a transport direction of the paper and a drum-shaped roller disposed opposite the oblique roller with the paper pinched therebetween. In such a printer, the position of the paper is determined by the lateral end portion of the paper making contact with a reference guide (see Patent Document 1 for example).

Patent Document 1: JP-B-2966243

Patent Document 2: JP-A-2000-233850

However, in the technique of Patent Document 1, the position of the paper is determined in the paper cassette. Accordingly, when the positional relation between the apparatus and the paper cassette is not determined with high precision, the paper is obliquely fed and thus the corner portion of the paper makes contact with a lateral wall or the like forming a transport path, thereby bending the paper. Therefore, paper jam may occur.

In the technique of Patent Document 2, when the reversely fed paper is disposed close to the reference guide, the corner portion of the paper is bent when making contact with the reference guide to be bent before the position of the paper is determined by the oblique roller and the drum-shaped roller. Therefore, paper jam may also occur.

SUMMARY

An advantage of some aspects of at least one embodiment of the invention is to provide a paper feeding device capable of feeding a medium while determining the position of a medium with high precision without causing paper jam and to provide a recording apparatus and a information processing apparatus having the same. The advantage can be attained by at least one of the following aspects:

A first aspect of at least one embodiment of the invention is to provide a paper feeding device comprising: a reference guide surface that contacts a lateral end portion of a sheet-shaped medium along a guide path for transporting the medium; a tapered guide surface that is inclined outwardly from the reference guide surface toward an upstream side of a transport direction and contacts the lateral end portion of the medium; a paper feeding roller that rotates to transport the medium in a direction parallel to the reference guide surface while the paper feeding roller contacts a surface of the medium; and a medium cassette that stores the medium, wherein the medium cassette stores the medium so as to be inclined with respect to the reference guide surface so that a rear end of the lateral end portion of the stored medium at a side of the reference guide surface is positioned outside an imaginary extension surface of the reference guide surface According to the paper feeding device with such a configuration, the medium cassette stores the medium so as to be inclined with respect to the reference guide surface so that the rear end of the lateral end portion of the stored medium at the side of the reference guide surface is positioned outside the imaginary extension surface of the reference guide surface, and the paper feeding roller transports the medium in a direction parallel to the reference guide surface. Therefore, the lateral end portion of the medium on the upstream side of the transport direction makes contact with the tapered guide surface, the medium is rotated about the contact portion as a supporting point, and thus it is possible to cause the lateral end portion of the medium to move along the tapered guide surface. Since the lateral end portion of the medium makes contact with the reference guide surface and the medium is rotated about the lateral end portion on the upstream side of the transport direction, it is possible to transport the medium to the downstream side in a state that the position of the medium is determined when the lateral end portion of the medium makes contact with the reference guide surface.

It is preferable that the paper feeding device further comprise a pickup roller that is disposed at the upstream side of the paper feeding roller and rotates to transport the medium in the direction parallel to the reference guide surface while the pickup roller contacts a surface of the medium stored on a top portion of the medium cassette.

According to such a configuration, the medium stored on the top portion of the medium cassette is continuously fed by the pickup roller in the direction parallel to the reference guide surface. Therefore, it is possible to bring the lateral end portion of the medium into contact with the tapered guide surface in a secure manner.

It is preferable that the medium cassette stores the medium so as to be inclined with respect to the reference guide surface such that an inclination angle of the lateral end portion of the medium at the side of the reference guide surface with respect to the reference guide surface is greater than an inclination angle of the tapered guide surface with respect to the reference guide surface.

According to such a configuration, when the medium is continuously fed, the portion (rear end portion) on the upstream side of the medium makes contact with the tapered guide portion faster than the portion (front end portion) on the downstream side of the medium. Therefore, it is possible to prevent a paper jam in a secure manner when the corner portion of the front end portion of the medium at the side of the reference guide surface makes contact with the tapered guide surface, and thus it is possible to continuously send out the medium in a smooth manner while preventing the paper jam in a more secure manner.

It is preferable that the pickup roller is disposed between the reference guide surface and a center in a width direction of the medium stored in the medium cassette. It is also preferable that the medium cassette has a separation wall that is disposed at a side of the front end portion of the stored medium and contacts a back surface of the medium.

According to such a configuration, the resistance applied from the separation wall to the portion opposite to the portion of the medium at the side of the edge guide changes about the pickup roller and becomes greater than that applied to the portion of the medium at the side of the edge guide. Accordingly, a force is applied to the rear end portion of the medium in a direction toward the edge guide, and the rear end of the lateral end portion of the medium makes contact with the edge guide. Therefore, it is possible to prevent a paper jam when the corner portion of the front end portion of the medium makes contact with the edge guide.

It is preferable that the edge guide is provided with a connection portion that is integrally connected to a top of the medium cassette.

According to such a configuration, the top of the medium cassette for storing the medium is integrally connected to the connection portion of the edge guide, which is integrally formed with the reference guide surface and the tapered guide surface that determine the position in the width direction of the medium. Accordingly, it is possible to position the middle[1] of the medium cassette at a predetermined position with respect to the edge guide. Since the position of the medium cassette is inclined with respect to the edge guide, it is possible to prevent a paper jam in a secure manner when the corner portion of the continuously fed medium makes contact with the edge guide.

It is preferable that the medium cassette has a lift hopper that lifts up the medium stored in a storage space to position the medium on the top portion at a predetermined position, and that an upper end portion of a lateral wall that forms the storage space of the medium cassette is inclined toward a predetermined position as the wall goes up.

According to such a configuration, since the lift hopper lifts up the medium stored in a stacked manner, it is possible to allow the medium on the top portion to be guided toward a predetermined position by the lateral wall, and it is possible to position the continuously fed medium on the top portion at a predetermined position in a secure manner. Therefore, since the position of the medium is inclined with respect to the edge guide, it is possible to prevent paper jam in a secure manner when the corner portion of the continuously fed medium makes contact with the edge guide.

A second aspect of at least one embodiment of the invention provides a recording apparatus including a recording processing portion that performs a recording process on the medium that is fed by the paper feeding device.

A third aspect of at least one embodiment of the invention is to provide an information processing apparatus including a readout processing portion that reads out information about characters or images from the medium that is fed by the paper feeding device. According to the recording apparatus or the information processing apparatus, since the paper feeding device can feed the medium while determining the position of the medium with high precision without causing paper jam, it is possible to perform a recording process or a readout process on the medium in a smooth manner and with high precision.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a paper feeding device according to an embodiment of the invention and a recording apparatus having the same will be described in detail with reference to the drawings.

In the present embodiment, a printer such as an ink jet printer that performs a printing process is exemplified as the recording apparatus. In addition to the printer, an information processing apparatus such as a copier or a facsimile can be exemplified as a paper feeding device of the invention. In the present embodiment, a paper is exemplified as a sheet-shaped medium on which a printing process is performed.

Figure 1:
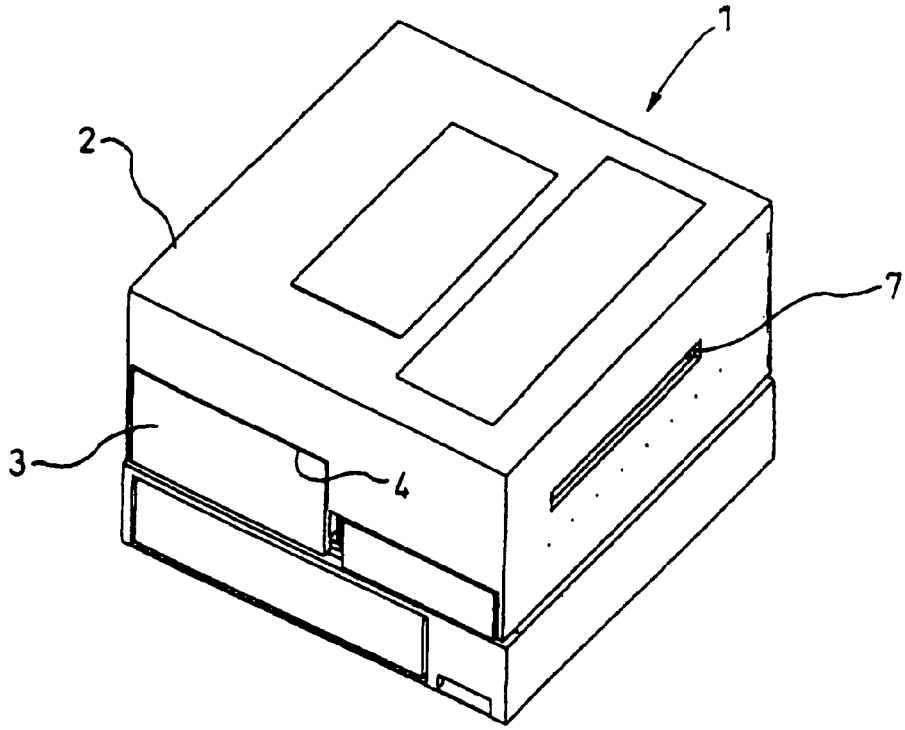
FIG. 1 is a perspective view illustrating an appearance of a printer according to an embodiment of the invention.

FIG. 1 is a perspective view illustrating an appearance of a printer according to an embodiment of the invention.

Figure 2:
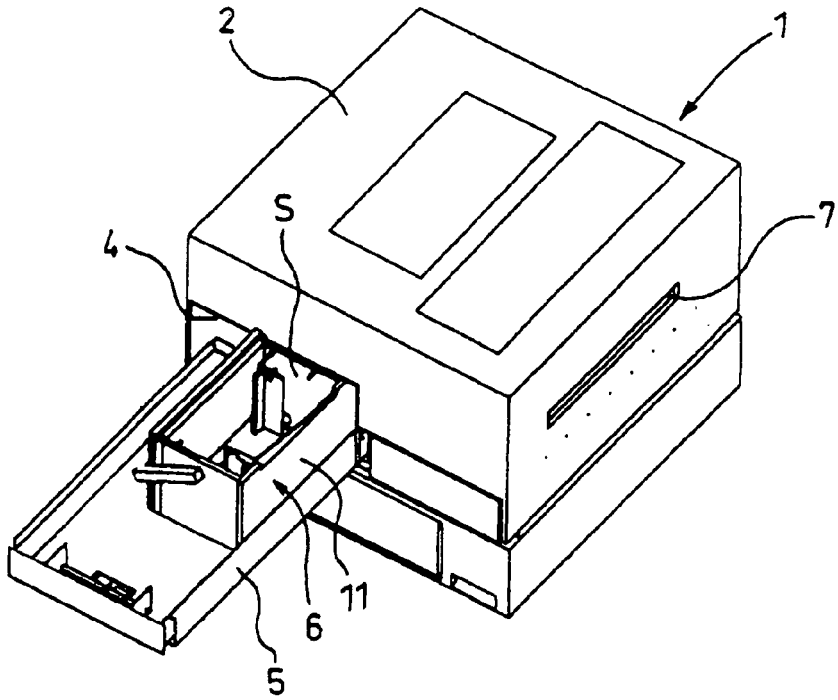
FIG. 2 is a perspective view illustrating the appearance of the printer in a state in which a drawer is drawn out.

A printer (recording apparatus) 1 according to the present embodiment is an ink jet printer for business use. As shown in FIG. 1, in a front surface of the case 2 is provided a window portion 4 having an open-close door 3 that is openable in an outward direction. As shown in FIG. 2, a drawer 5 is provided to advance to and retreat from the case 2 in a state that the open-close door 3 is open, so that the drawer 5 is drawn out from the case 2.

A paper cassette (medium cassette) 6 having a paper P stored in a stacked state is detachably attached to the drawer 5. On the paper P stored in the paper cassette 6, a printing process is performed by a recording processing portion of the apparatus, and the printed paper P is discharged from a paper discharge port 7 on a lateral surface of the case 2.

Figure 3:
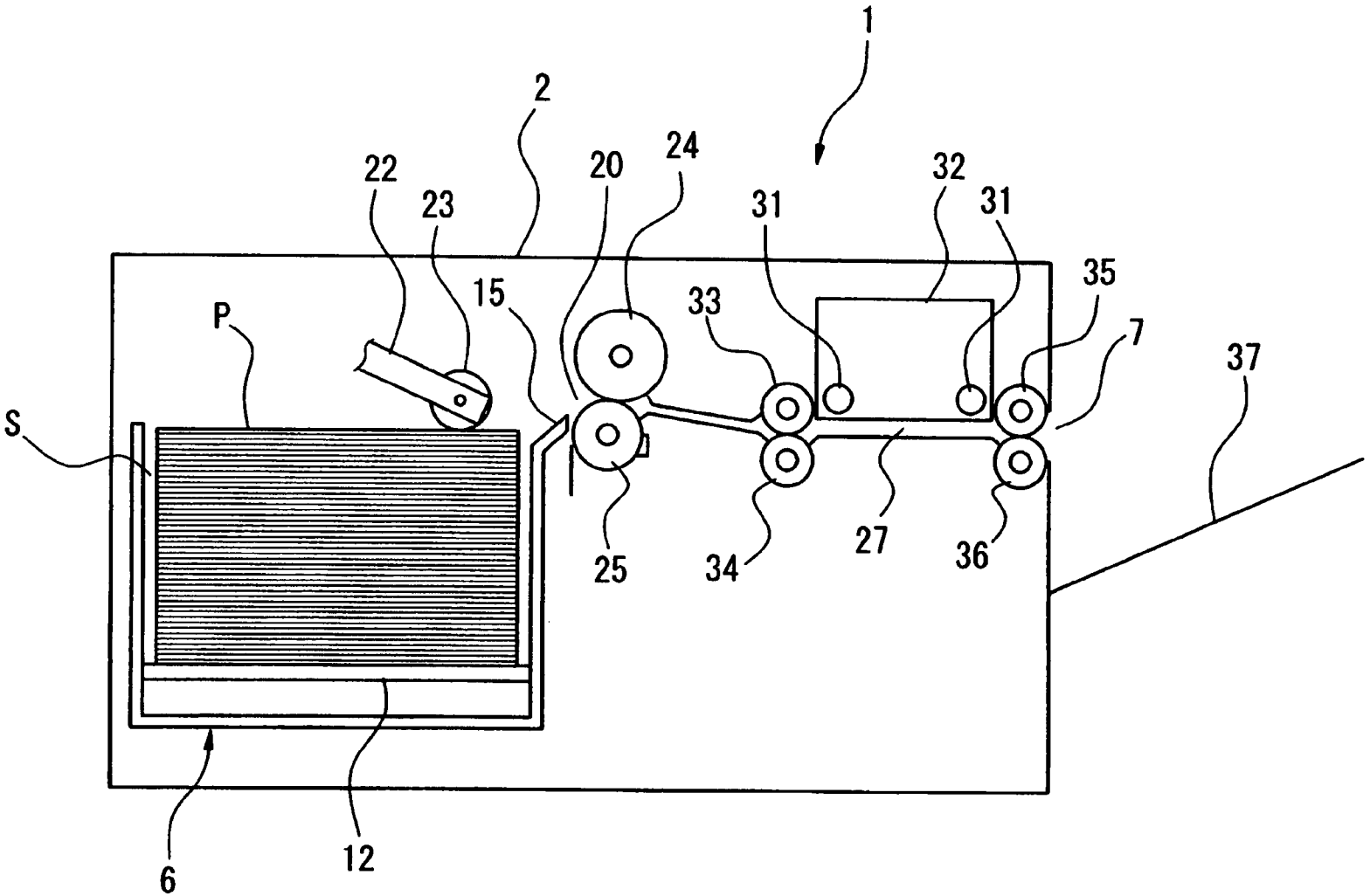
FIG. 3 is a schematic cross-sectional side view illustrating the inside of printer according to the invention.
Figure 4:
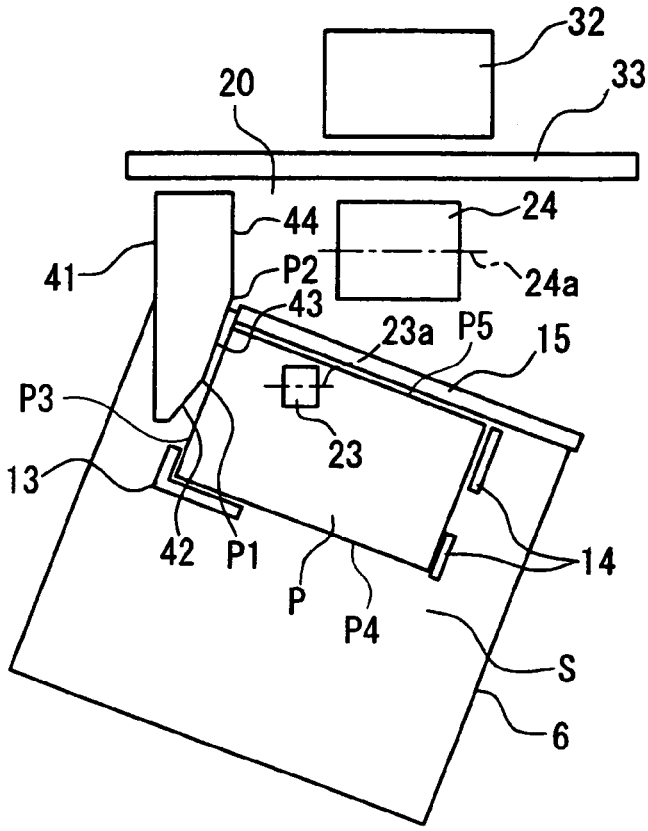
FIG. 4 is a plan view illustrating a part of a paper feeding device.

As shown in FIG. 3, the printer 1 performs a recording process onto the paper P while moving the paper P along a substantially linear path. The paper cassette 6 provided in the case 2 has a cassette body 11 (see FIG. 2) with a concave shape that is open at the upper portion thereof. A storage space S for storing a plurality of papers P in a stacked state is formed in the cassette body 11. A lift hopper 12 is provided in the storage space S, and the paper P stored in a stacked state is lifted up by the lift hopper 12 to position the paper P on the top portion at a predetermined height. As shown in FIG. 4, the cassette body 11 is provided with paper guides 13 and 14, and the paper P stored in the storage space S by the paper guides 13 and 14 to store the paper P is stored in a stacked state while being aligned.

In the cassette body 11, a separation wall 15 that is gradually inclined upward in a forward feeding direction is formed on the front in a feeding direction of the printer 1 so as to be gradually inclined. A high friction material is applied or attached onto the surface of the separation wall 15.

In the case 2, a pickup roller 23 is provided in a front end of a frame 22 that is supported in a fluctuatable manner, and the pickup roller 23 is disposed above the paper P that is loaded in the paper cassette 6 from the window portion 4. The pickup roller 23 makes contact with the paper P stored on the top portion of the paper cassette 6 to send out the paper P on the top portion to a paper guide path 20 on the downstream side one by one so that the paper P is fed to a space between a paper feeding roller 24 and a retard roller 25 that are provided on the paper guide path 20.

The paper feeding roller 24 is disposed at the substantially central position of the paper guide path 20. The paper feeding roller 24 feeds the fed paper P in the backward direction one by one while biasing the paper P, together with the retard roller 25 on the lower side thereof. The retard roller 25 is rotatably supported in a state that a predetermined torque is applied thereto by a torque limiter (not shown), and the retard roller 25 has a separation function to separate the paper P on the top portion from the papers P overlapping with the top paper when the plurality of papers P are continuously fed from the paper cassette 6.

The paper feeding roller 24 has a relatively large diameter and a small width, and an outer layer of the paper feeding roller 24 is formed of rubber or the like and has a large thickness around a rotation shaft.

A transport path 27 for transporting the paper P toward the rear surface of the printer 1 to discharge the paper P onto a paper discharge tray 37 is provided on the downstream side of the paper feeding roller 24 and the retard roller 25.

In the middle portion of the transport path 27, a print head (recording processing portion) 32 is provided to reciprocate along a plurality of guide shafts 31 extending in a horizontal direction perpendicular to the transport direction of the paper P, and the print head 32 prints characters or images on the fed paper P.

The transport path 27 includes transport rollers 33 and 34 that are provided on the upstream side of the print head 32 and pinch and transport the paper P to a printing position of the print head 32, and paper discharge rollers 35 and 36 that are provided on the downstream side of the print head 32 and pinch and discharge the paper P printed by the print head 32 onto the paper discharge tray 37 disposed on the lower portion of the paper discharge port 7.

Figure 5:
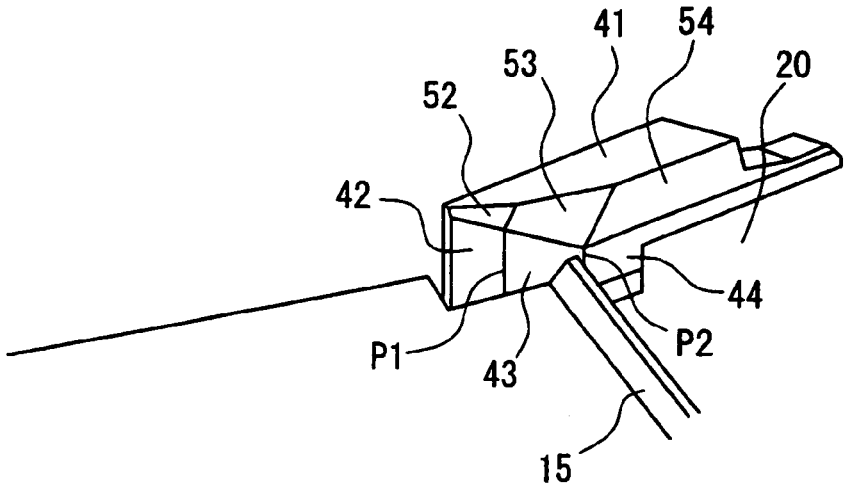
FIG. 5 is a perspective view illustrating an edge guide constituting a paper feeding device.

As shown in FIGS. 4 and 5, an edge guide 41 is disposed on a side of the paper guide path 20 in the case 2. The edge guide 41 includes a first tapered guide surface 42, a second tapered guide surface 43, and a reference guide surface 44, in an order from the upstream side of the paper guide path 20. The reference guide surface 44 is formed by a vertical surface parallel along the paper guide path 20, and the second tapered guide surface 43 is gradually inclined outwardly toward the upstream direction of the paper guide path 20 with respect to the reference guide surface 44. The first tapered guide surface 42 is inclined more outward toward the upstream side of the paper guide path 20 than the second tapered guide surface 43.

In the edge guide 41, a first supporting point P1 is defined at a bent portion between the first tapered guide surface 42, which is an end portion on the upstream side of the second tapered guide surface 43, and the second tapered guide surface 43. A second supporting point P2 is defined at a bent portion between the second tapered guide surface 42, which is an end portion on the upstream side of the reference guide surface 44, and the reference guide surface 44.

A first tapered introduction surface 52, a second tapered introduction surface 53, and a parallel introduction surface 54 that have a tapered shape and gradually protrude upwardly are formed on the upper portions of the first tapered guide surface 42, the second tapered guide surface 43, and the reference guide surface 44 of the edge guide 41, respectively.

Figure 6:
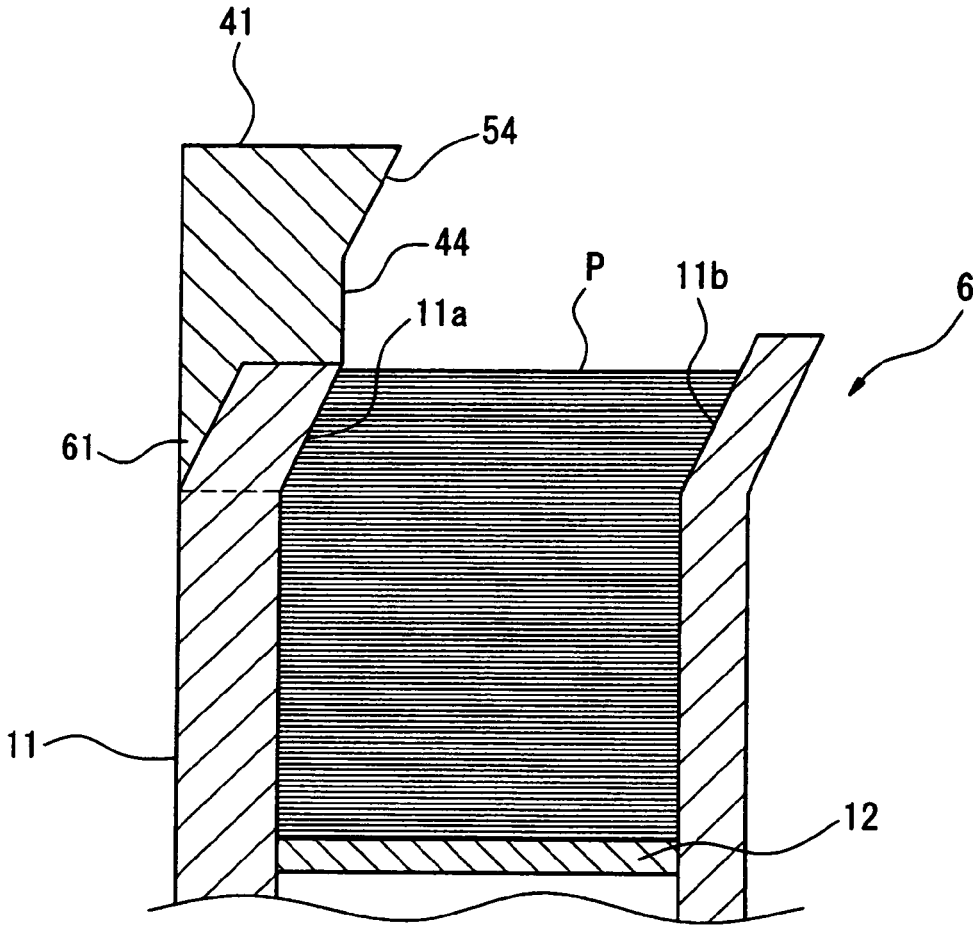
FIG. 6 is a schematic cross-sectional view illustrating a cassette body of a paper cassette installed in a case.
Figure 7:
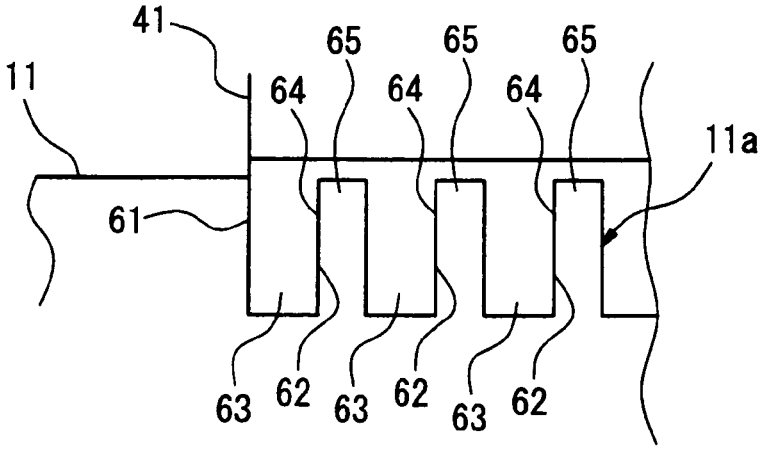
FIG. 7 is a front view illustrating a connection portion between the cassette body and the edge guide.

As shown in FIG. 6, the lower portion of the edge guide 41 is formed of a connection portion 61 that is connected to the upper end portion of one lateral wall 11*a* of the cassette body 11. As shown in FIG. 7, the connection portion 61 has a pectinate shape in which a plurality of concave portions 62 and convex portions 63 are formed. The upper end portion of the lateral wall 11*a* of the cassette body 11, which is connected to the connection portion 61, also has a pectinate shape in which a plurality of concave portions 64 and convex portions 65 are formed. The convex portions 63 of the connection portion 61 and the convex portions 65 of the lateral wall 11*a* are integrally fitted to the concave portions 62 of the connection portion 61 and the concave portions 64 of the lateral wall 11*a*, respectively.

The connection portion 61 has a tapered shape that sequentially protrudes upward toward the first tapered guide surface 42, the second tapered guide surface 43, and the reference guide surface 44. The upper end portion of the other lateral wall 11*b* of the cassette body 11 has a tapered shape parallel to the connection portion 61.

Figure 8:
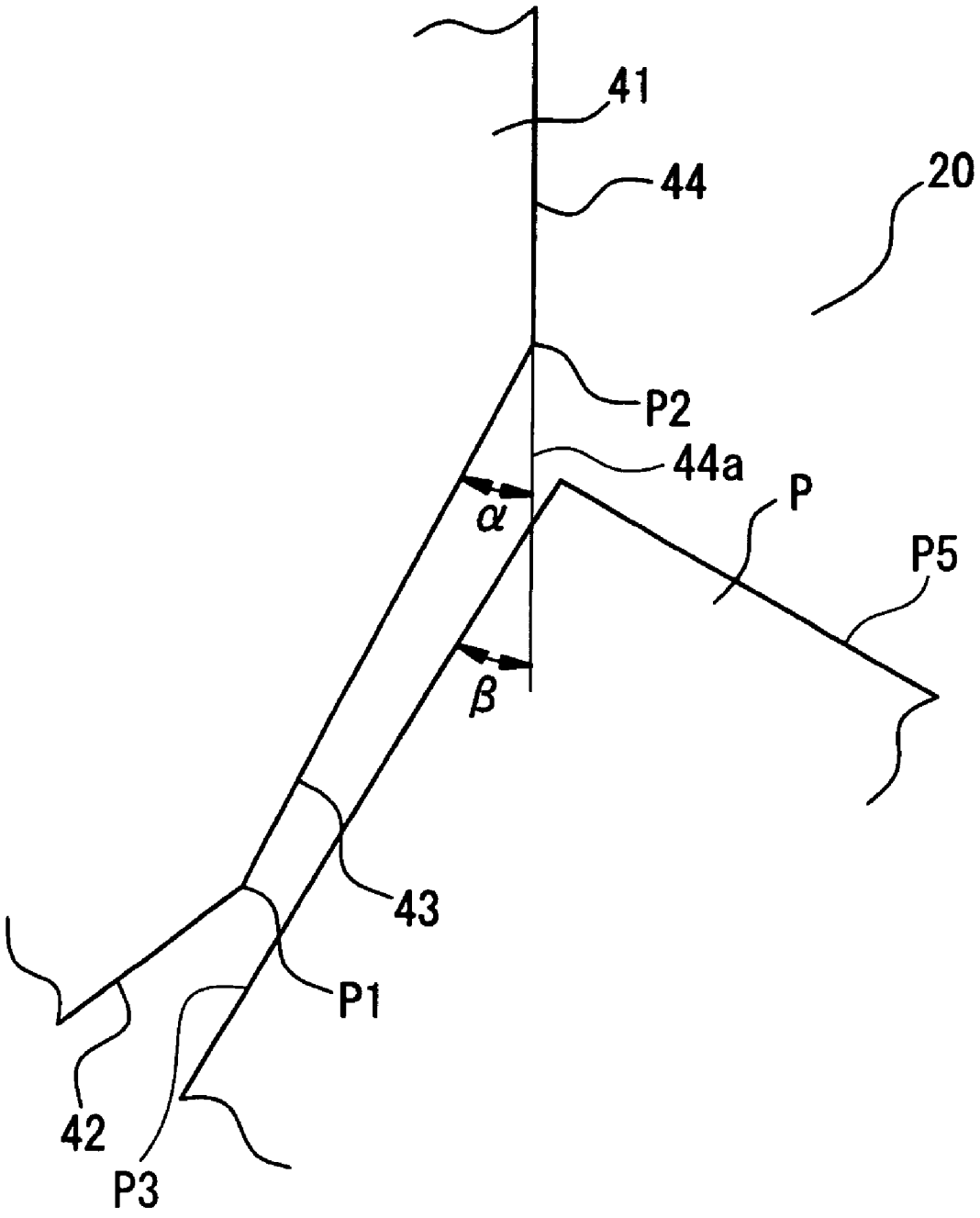
FIG. 8 is a plan view illustrating a positional relation between the edge guide and a paper.

As shown in FIG. 4, the paper cassette 6 is installed in the case 2 in a state in which the paper cassette 6 is inclined with respect to the paper guide path 20 in a plan view. As shown in FIG. 8, in the paper P located in the top portion in the paper cassette 6 installed in the case 2, the corner portion at the side of the front end portion P5 that is the downstream side of the paper guide path 20 at the side of the edge guide 41 is disposed closer to the downstream side than the first supporting point P1. The lateral end portion P3 at the side of the edge guide 41 forms an inclination angle $\beta$ greater than an inclination angle $\alpha$ of the second tapered guide surface 43 connected between the first supporting point P1 and the second supporting point P2, with respect to a virtual extension surface 44*a* of the reference guide surface 44.

In order to transport the paper P in a direction parallel to the reference guide surface 44, the paper feeding roller 24 and the pickup roller 23 are disposed so that the central axes 24*a* and 23*a* thereof are perpendicular to the reference guide surface 44 in a plan view.

The central axis 23*a* of the pickup roller 23 is disposed substantially at the same position as the first supporting point P1 in the paper transport direction on the paper guide path 20, and the central axis 24*a* of the paper feeding roller 24 is disposed on the downstream side from the second supporting point P2 in the paper transport direction on the paper guide path 20.

The paper feeding roller 24 is disposed at the substantially central position in a width direction of the paper guide path 20, and the pickup roller 23 is disposed closer to the edge guide 41 than the paper feeding roller 24.

Next, a case where the printer 1 performs a printing process will be described.

First, the paper cassette 6 in which the paper P is stored is installed in the drawer 5, and then the drawer 5 is pushed in the printer 1. Thus, the paper cassette 6 is installed in the case 2 in a state in which the paper cassette 6 is inclined with respect to the paper guide path 20 in a plan view, the convex portions 63 of the connection portion 61 of the edge guide 41 and the convex portion 65 of the lateral wall 11*a* of the cassette body 11 are integrally fitted to the concave portions 62 of the connection portion 64 of the edge guide 41 and to the concave portion 64 of the lateral wall 11*a* of the cassette body 11, respectively.

Then, as the lift hopper 12 of the paper cassette 6 is lifted up, the paper P stored in the storage space S in a stacked state is lifted upward. Accordingly, the paper P on the top portion is guided along the taper-shaped connection portion 61 that sequentially protrudes upward toward the first tapered guide surface 42, the second tapered guide surface 43, and the reference guide surface 44; and along the taper-shaped upper end portion of the other lateral wall 11*b* of the cassette body 11 parallel to the connection portion 61. Accordingly, the paper P on the top portion is disposed at a predetermined position, so that the corner portion of the paper P at the side of the front end portion P5 that is on the downstream side of the paper guide path 20 at the side of the edge guide 41 is disposed closer to the downstream side than the first supporting point P1, and so that the lateral end portion P3 of the paper P at the side of the edge guide 41 forms an inclination angle β greater than an inclination angle α of the second tapered guide surface 43 connected between the first supporting point P1 and the second supporting point P2, with respect to the paper guide direction of the paper guide path 20.

In this state, when a print instruction is sent, the printer 1 starts a paper feeding operation to perform a printing process on the paper P.

Specifically, the pickup roller 23 moves downward and rotates to make contact with the paper P disposed at a predetermined position, and thus the paper P on the top portion is continuously fed.

The paper P is fed in such a manner that the front end portion P5 of the paper P makes contact with the separation wall 15 to separate the paper P from another paper P thereunder. In this case, the pickup roller 23 is disposed closer to the edge guide 41 than the paper feeding roller 24 disposed at the substantially central position in the width direction of the paper guide path 20, the paper P is inclined with respect to the paper guide path 20 in a plan view, and the edge guide 41 side of the paper P is disposed on the downstream side. Accordingly, when the paper P makes contact with the separation wall 15, the resistance applied from the separation wall 15 to the portion opposite to the portion of the paper P at the side of the edge guide 41 changes about the pickup roller 23 and becomes greater than that applied to the portion of the paper P at the side of the edge guide 41.

A force is applied to the rear end portion P4 (see FIGS. 9A, 9B and 9C) of the paper P in a direction toward the edge guide 41, and thus the paper P is slightly rotated in a clockwise direction as viewed from the top of the printer about the pickup roller 23 in a plan view. Accordingly, the lateral end portion P3 at the side of the edge guide 41 makes contact with the first supporting point P1 without causing paper jam when the corner portion of the front end portion P5 at the side of the edge guide 41 makes contact with the edge guide 41.

When the paper P is rotated substantially, the lateral end portion P3 of the paper P is guided to the first tapered guide surface 42 along the first tapered introduction surface 52 and makes contact with the first tapered guide surface 42. Then, the lateral end portion P3 makes contact with the first supporting point P1.

When the lateral end portion P3 of the paper P makes contact with the first supporting point P1, a torque in a counterclockwise direction acts on the paper P about the first supporting point P1 as a supporting point. Accordingly, the paper P is continuously fed to the downstream side of the paper guide path 20 in a state in which the paper makes contact with the second tapered guide surface 43 while the lateral end portion P3 of the paper P is pressed down by the second tapered introduction surface 53.

Since the central axis 23*a* of the pickup roller 23 is disposed substantially at the same position as the first supporting point P1 in the paper transport direction of the paper guide path 20, it is possible to apply a torque to the paper in a secure manner to rotate the paper P in a counterclockwise direction at the first supporting point P1 due to the force of the pickup roller 23 continuously sending the paper P.

The paper P fed as described above is fed between the paper feeding roller 24 and the retard roller 25, and the paper P is pinched between the paper feeding roller 24 and the retard roller 25. Then, the paper P is fed to the downstream side of the paper guide path 20 due to the rotation of the paper feeding roller 24.

In this case, even when another paper P under the paper P on the top portion subsequent to the paper on the top portion is fed between the paper feeding roller 24 and the retard roller 25, the overlapped and transported paper P is separated by the retard roller 25 to which a predetermined torque is applied.

The lateral end portion P3 of the paper P at the side of the edge guide 41 is pressed by the edge guide 41, and the paper P is rotated in a counterclockwise direction about the second supporting point P2 as a supporting point by the paper feeding roller 24. The lateral end portion P3 at the side of the edge guide 41 is disposed along the reference guide surface 44 of the edge guide 41 to determine the position of the paper P parallel to the paper guide path 20.

Hereinafter, an operation of the paper feeding roller 24 determining the position of the paper P will be described.

Figure 9A:
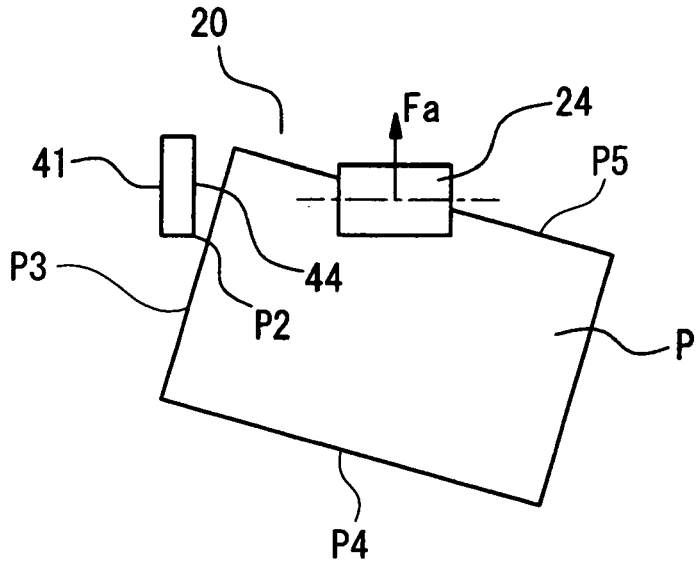
FIGS. 9A to 9C are schematic plan views illustrating a principle of determining a position of a paper.
Figure 9B:
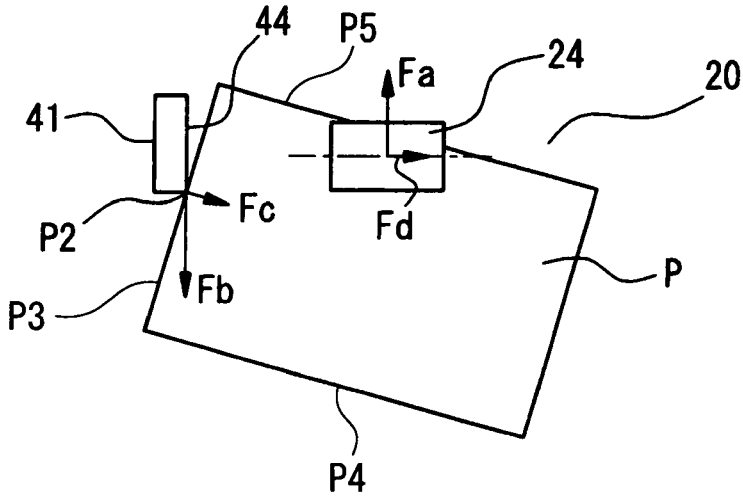
Figure 9C:
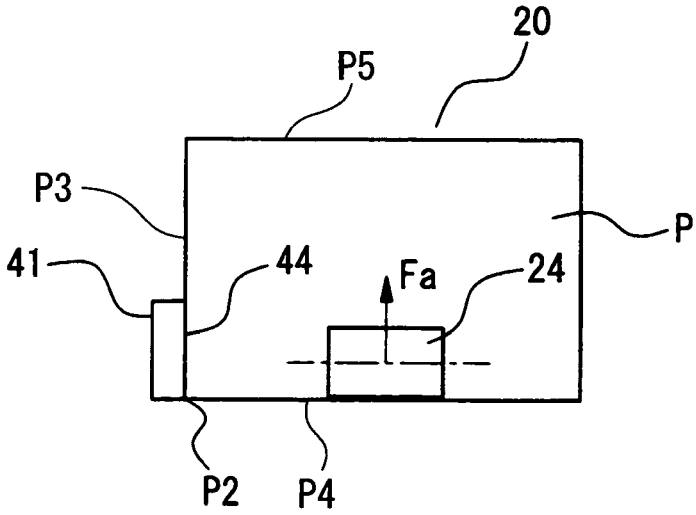
Figure 10:
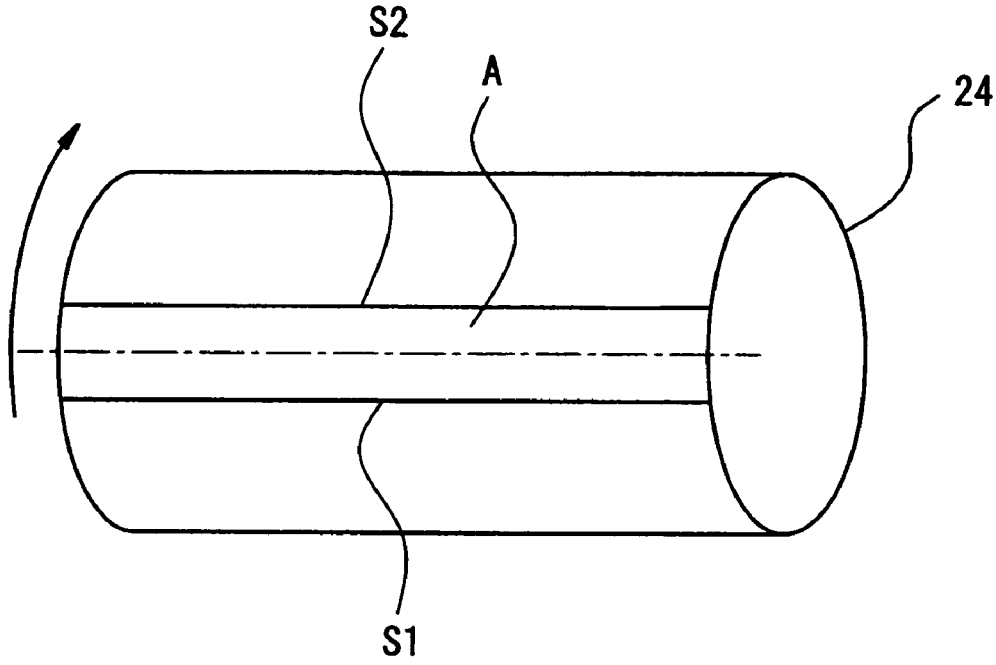
FIG. 10 is a schematic perspective view illustrating a paper feeding roller as viewed from a contact surface between the paper feeding roller and a paper.
Figure 11:
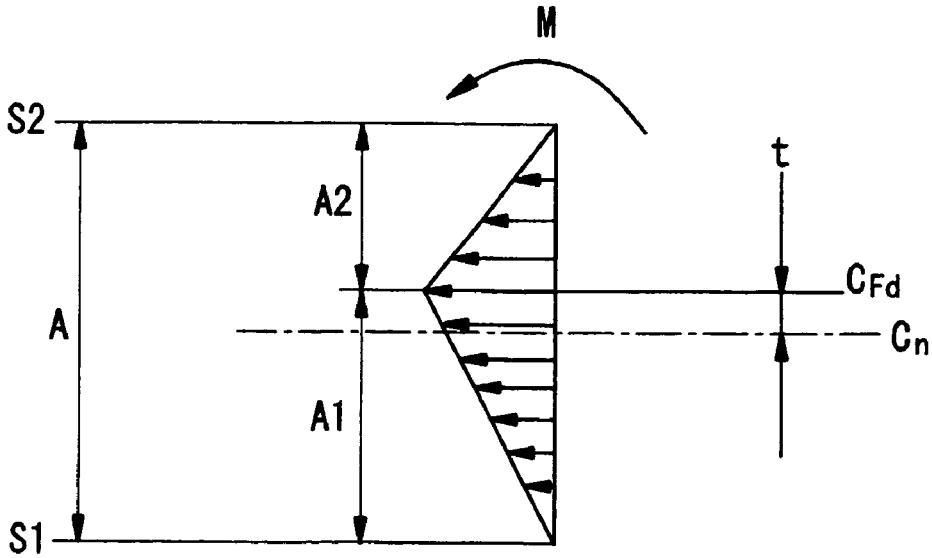
FIG. 11 is a view illustrating a rotation moment of a paper generated by the paper feeding roller.

FIGS. 9A to 9C are schematic plan views illustrating a principle of determining a position of a paper, FIG. 10 is a schematic perspective view illustrating a paper feeding roller as viewed from a contact surface between the paper feeding roller and a paper, and FIG. 11 is a view illustrating a rotation moment of a paper generated by the paper feeding roller.

As shown in FIG. 9A, when the paper P is transported by the paper feeding roller 24 without contacting the edge guide 41, the paper P is transported in a state that the paper P is inclined with respect to the paper guide path 20 due to a transport force Fa of the paper feeding roller 24.

Then, as shown in FIG. 9B, when the lateral end portion P3 of the paper P makes contact with the second supporting point P2 of the edge guide 41, a repulsive force Fb is applied from the edge guide 41 to the paper P and a force Fc is applied to the paper P in a direction of bending the paper P.

In this case, when the paper P is relatively elastic paper such as blotting paper, the bending force Fc acts on the paper P. Accordingly, a transverse force Fd (Fc>Fd) as a load acts on the paper feeding roller 24, and thus the outer layer, which is formed of rubber or the like, of the feeding roller 24 is bent in the transverse direction.

As shown in FIG. 10, in an area A between a contact start point S1 and a contact end point 52 with the paper P, the paper feeding roller 24 does not make contact with the paper P up to the contact start point S1 in the vicinity of the contact start point S1 to cause a reasonable contact. However, the paper feeding roller 24 is elastically deformed due the influence of the transverse force Fd thereafter.

As shown in FIG. 11, an area where the friction force between the paper P and the paper feeding roller 24 is greater than the transverse Fd becomes a cohesion area A1 where the surface of the paper feeding roller 24 does not slide and makes contact with the paper. An area where the transverse force Fd is greater than the friction force between the paper P and the paper feeding roller 24 becomes a sliding area A2 where the surface of the paper feeding roller 24 slides and makes contact with the paper P.

A distribution center CFd of the transverse force Fd in the cohesion area A1 and the sliding area A2 is offset at the side of the contact end point S2 with respect to the pinch center Cn of the paper P between the paper feeding roller 24 and the retard roller 25. The more the transverse force Fd is smaller than the maximum friction force of the paper feeding roller 24 against the paper P, the more the offset amount increases.

As described above, the distribution center CFd of the transverse force Fd is offset at the side of the contact end point S2 with respect to the pinch center Cn. Accordingly, a rotation moment M (rotation moment M=transverse force Fd×offset amount t) is generated on the surface of the paper feeding roller 24, and the rotation force acts on the paper P due to the rotation moment M.

As a result, the paper P is rotated in a counterclockwise direction about the second supporting point P2 as a supporting point. Then, as shown in FIG. 9C, the lateral end portion P3 at the side of the edge guide 41 is disposed along the reference guide surface 44 of the edge guide 41, and the paper P is transported by the transport Force Fa of the paper feeding roller 24 in a state that the position of the paper P is determined parallel to the paper guide path 20.

The larger the thickness of the outer layer, which is formed of rubber of the like, of the paper feeding roller 24, the more the paper feeding roller 24 is elastically deformed. Accordingly, it is possible to apply a large torque to the paper P. In addition, the smaller the width of the paper feeding roller 24, the more it is possible to reduce a binding force of the paper P. In this case, it is possible to apply a larger torque to the paper P as well.

In the embodiment, the first tapered introduction surface 52, the second tapered introduction surface 53, and the parallel introduction surface 54 that have a tapered shape and gradually protrude upward are formed on the upper portions of the first tapered guide surface 42, the second tapered guide surface 43, and the reference guide surface 44 of the edge guide 41, respectively. Accordingly, the lateral end portion P3 of the paper P at the time of determining the position of the paper P is securely guided to and makes contact with the first tapered guide surface 42, the second tapered guide surface 43, and the reference guide surface 44 by the first tapered introduction surface 52, the second tapered introduction surface 53, and the parallel introduction surface 54, and the transverse force Fd is smoothly applied to the paper feeding roller 24.

Since the central axis 24*a* of the paper feeding roller 24 is disposed closer to the downstream side in the paper transport direction of the paper guide path 20 than the second supporting point P2, the paper P after determining the position of the paper p is stably transported along the paper guide path 20 without applying an unnecessary torque to the paper P.

Since the pickup roller 23 is disposed closer to the edge guide 41 than the paper feeding roller 24 disposed at the substantially central position in the width direction of the paper guide path 20, the pickup roller 23 at the time of determining the position of the paper P becomes a load and a rotation moment is generated to incline the paper P toward the edge guide 41 about the paper feeding roller 24. Therefore, the position of the paper P is determined in a smooth manner.

Since a predetermined torque is applied to the retard roller 25 pinching the paper P together with the paper feeding roller 24, the outer layer of the paper feeding roller 24 is bent in a smooth manner. Accordingly, the paper P is rotated in a smoother manner.

The paper P, the position of which is determined by the reference guide surface 44 of the edge guide 41 and which is transported as described above, is then pinched between the transport rollers 33 and 34 and is transported along the transport path 27. Then, a position determination for a head positioning of the paper P with respect to the print head 32 is performed. At this time, since the position of the paper P has been determined and the paper P has been transported along the reference guide surface 44 of the edge guide 41, the positional determination of the paper P with respect to the print head 32 is performed with very high precision.

While the paper P, the position of which is determined with the high precision as described above, is transported by the transport rollers 33 and 34, a printing process is performed by the print head 23 that moves in the width direction and jets ink from a jetting nozzle. Then, the front end portion P5 is pinched between the paper discharge rollers 35 and 36, and the paper P is transported to the paper discharge port 7 and is discharged to the paper discharge tray 37.

According to the embodiment described above, the lateral end portion P3 of the paper P makes contact with the first supporting point P1 formed at the end portion on the upstream side of the second tapered guide surface 43 and is rotated at the first supporting point P1, and thus the lateral end portion P3 of the paper P moves along the second tapered guide surface 43 to send out the paper P to the downstream side. In addition, the lateral end portion P3 of the paper P makes contact with the second supporting point P2 formed at the end portion on the upstream side of the reference guide surface 44 and is rotated at the second supporting point P2, and thus the lateral end portion P3 of the paper P moves along the reference guide surface 44 to position the paper P on the downstream side and to transport the paper P. In this case, the corner portion of the front end portion P5 at the side of the edge guide 41 is disposed closer to the downstream side than the first supporting point P1 formed of the end portion on the upstream side of the second tapered guide surface 43. Accordingly, the corner portion of the paper P, in which paper jam easily occurs, does not make contact with the first tapered guide surface 42, the second tapered guide surface 43, or the reference guide surface 44 of the edge guide 41. Therefore, it is possible to continuously send the paper P positioned with high precision without occurrence of paper jam.

According to the printer 1 having the paper feeding device of this embodiment, since it is possible to feed the paper P that is positioned with high precision without causing paper jam, it is possible to perform a recording process on the paper P in a smooth manner and with high precision.

While the pickup roller 23 makes contact with the surface of the paper P, the pickup roller 23 rotates to continuously feed out the paper P on the top portion of the storage space S of the paper cassette 6 in a state in which the paper P is inclined with respect to the reference guide surface 44. The pickup roller 23 is disposed on the upstream side of the paper feeding roller 24. Accordingly, the paper P on the top portion in the storage space S of the paper cassette 6 is continuously fed out, and thus the lateral end portion P3 of the paper P makes secure contact with the first supporting point P1 formed at the end portion on the upstream side of the second tapered guide surface 43. Therefore, it is possible to prevent paper jam when the corner portion of the paper P makes contact with the second tapered guide surface 43 or the like.

The lateral end portion P3 of the paper P on the top portion at the side of the edge guide 41 forms an inclination angle $\beta$ that is greater than an inclination angle $\alpha$ of the second tapered guide surface 43, with respect to the paper guide path 20. Accordingly, when the paper P is continuously fed out, the corner portion of the paper P is prevented from making contact with the first tapered guide surface 42, and the second tapered guide surface 43, or the reference guide surface 44 in a secure manner. Therefore, it is possible to send out the paper P in a smooth manner while preventing paper jam in a more secure manner.

The pickup roller 23 is disposed closer to the edge guide 41 than to the center of the storage space in the width direction of the paper P in the storage space S. Accordingly, when the paper P is continuously fed out, the resistance applied from the separation wall 15 of the cassette body 11 to the portion opposite to the portion of the paper P at the side of the edge guide 41 changes about the pickup roller 23 and becomes greater than that applied to the portion of the paper P at the side of the edge guide 41. Thus, a force is applied to the rear end portion P4 of the paper P in a direction toward the edge guide 41 to bring the rear end portion P4 at the side of the lateral end portion P3 of the paper P into contact with the edge guide 41. Therefore, it is possible to prevent paper jam when the corner portion of the paper P at the side of the front end portion P5 makes contact with the edge guide 41.

The edge guide 41 is provided with the connection portion 61 that is integrally connected to the top of the cassette body 11, and the top 11*a* of the cassette body 11 of the paper cassette 6 for storing the paper P is integrally connected to the edge guide 41 for positioning the paper P by the connection portion 61. Accordingly, the paper P of the cassette body 11 can be disposed at a predetermined position with respect to the edge guide 41 with high precision. Therefore, since the position of the cassette body 11 is inclined with respect to the edge guide 41, it is possible to prevent paper jam in a secure manner when the corner portion of the continuously fed paper P makes contact with the edge guide 41.

The cassette body 11 of the paper cassette 6 is provided with the lift hopper 12 that lifts up the paper P stored in the storage space S to position the paper on the top portion at a predetermined position, and the upper end portions of the lateral walls 11*a* and 11*b* that form the storage space S of the cassette body 11 are gradually inclined toward a predetermined position as they extend in the upwardly direction. Accordingly, since the lift hopper 12 lifts up the stored paper P in a stacked state, it is possible to guide the paper P on the top portion toward a predetermined position by the lateral walls 11*a* and 11*b*, and it is possible to position the paper P on the top portion, at a predetermined position in a secure manner. Therefore, since the position of the paper P is inclined with respect to the edge guide 41, it is possible to prevent paper jam in a secure manner when the corner portion of the continuously fed paper P makes contact with the edge guide 41.

In addition, the printer 1 has a front-feeding rear-discharge type to move the paper P along a linear path and to perform a recording process. Accordingly, even when a printing process is performed on a large paper P, the paper P is fed from a paper insertion port (not shown) disposed on the rear surface of the case 2 and the paper P is pinched between the transport rollers 33 and 34 to be fed to the transport path 27, and thus it is possible to perform a printing process by the print head 32, without a special device.

In the embodiment, the ink jet printer is exemplified as the recording apparatus, but the invention is not limited to the ink jet type. For example, the invention may be applied to a dot-impact printer, and the invention may be also applied to a copier, a facsimile, or the like, in addition to the printer.

In the embodiment, the paper is exemplified as the sheet-shaped medium, but a medium formed of a resin film or the like may be also applied to the invention.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A feeding device comprising:

a medium cassette configured to store a plurality of sheet-shaped media in a stacked state;

a feeding roller configured to rotate to transport a topmost medium of the media along a guide path in a transport direction; and a guide disposed at one side of the guide path and comprising:

a reference guide surface that is parallel to the transport direction and configured to contact a lateral end portion of the topmost medium to guide the topmost medium along the guide path in the transport direction; and a tapered guide surface that is inclined outward from the reference guide surface toward an upstream side in the transport direction and configured to contact the lateral end portion of the topmost medium;

wherein the medium cassette is disposed so as to be inclined with respect to the reference guide surface in a plan view so that a rear end of the lateral end portion of the stored topmost medium at the one side of guide path is positioned outside an imaginary extension surface of the reference guide surface.

2. The feeding device according to claim 1, wherein the reference guide surface and the tapered guide surface are integrally formed with each other.

3. The feeding device according to claim 1, further comprising a pickup roller that is disposed at the upstream side of the feeding roller in the transport direction and configured to rotate to transport the topmost medium in the transport direction.

4. The feeding device according to claim 1, wherein the medium cassette is disposed so as to be inclined with respect to the reference guide surface in the plan view such that an inclination angle of the lateral end portion of the topmost medium at the one side of the guide path with respect to the reference guide surface is greater than an inclination angle of the tapered guide surface with respect to the reference guide surface.

5. The feeding device according to claim 3, wherein the pickup roller is disposed between the reference guide surface and a center in a width direction of the topmost medium stored in the medium cassette.

6. The feeding device according to claim 5, wherein the medium cassette has a separation wall that is disposed at a downstream side in the transport direction and configured to contact a back surface of the topmost medium to separate a second medium from the topmost medium.

7. The feeding device according to claim 2, wherein the guide is provided with a connection portion that is connectable to a top portion of the medium cassette.

8. The feeding device according to claim 1, wherein the medium cassette comprises:

a lateral wall defining a storage space for the plurality of media; and a lift hopper that lifts up the plurality of media stored in the storage space to position the topmost medium at a predetermined position, and wherein an upper end portion of the lateral wall is inclined toward a predetermined position as the wall goes up.

9. A recording apparatus comprising the feeding device according to claim 1 and a recording processing portion that performs a recording process on the medium that is fed by the feeding device.

10. An information processing apparatus comprising the feeding device according to claim 1 and a readout processing portion that reads out information about characters or images from the medium that is fed by the feeding device.

11. The feeding device according to claim 3, wherein a distance between the feeding roller and the reference guide surface is greater than a distance between the pick up roller and the reference guide surface.

12. The feeding device according to claim 1, wherein a central axis of the feeding roller is disposed at a downstream side of a supporting point which is defined at a portion between the tapered guide surface and the reference guide surface in the transport direction.

13. A feeding device comprising:

a guide path along which a medium can be transported;

a reference guide surface that extends along the guide path and constitutes a part of the guide path; and a tapered guide surface that is inclined outward from the reference guide surface toward an upstream side of the guide path;

a feeding roller configured to transport the medium in a direction parallel to the reference guide surface; and a medium cassette configured to store the medium and disposed so as to be inclined with respect to the reference guide surface in a plan view so that a rear end of a lateral end portion of the stored medium at a side of the reference guide surface is outwardly offset from the reference guide surface.

* * * * *